United States Patent [19]

Bushey et al.

[11] 4,092,167

[45] May 30, 1978

[54] PHOTOGRAPHIC FILM UNIT WITH TAPS ON BINDING ELEMENT

[75] Inventors: Robert D. Bushey, Westboro; Thomas P. McCole, South Natick, both of Mass.

[73] Assignee: Polaroid Corporation, Cambridge, Mass.

[21] Appl. No.: 756,503

[22] Filed: Jan. 3, 1977

[51] Int. Cl.[2] ..... G03C 1/48; G03D 9/02

[52] U.S. Cl. ..... 96/76 C; 354/304

[58] Field of Search ..... 96/76 C; 354/304

[56] References Cited

U.S. PATENT DOCUMENTS

| | | | |
|---|---|---|---|
| 3,607,285 | 9/1971 | Chen | 97/76 C |
| 3,761,269 | 9/1973 | Campbell | 96/76 C |
| 3,816,128 | 6/1974 | Chen | 96/76 C |

*Primary Examiner*—J. Travis Brown
*Assistant Examiner*—Richard L. Schilling
*Attorney, Agent, or Firm*—Philip G. Kiely; Sheldon W. Rothstein

[57] ABSTRACT

A photographic film unit comprising superposed photosensitive and image-viewing elements including an area adapted to be exposed and processed by an aqueous alkaline processing composition spread in a layer between the two elements to facilitate formation of a transfer image. A trap for excess processing compositon is affixed to one end of the unit and the entire assemblage is secured together by a binding element which is secured around and to at least three edges of the film unit including the edge to which is affixed the trap. The binding element comprises foldable tabs on both sides of the trap area and, when the element is folded to provide binding functionality, the tabs are located slightly inboard of the trap whereby the thickness of the film unit in the area of a tab is increased by the thickness of the tab.

2 Claims, 3 Drawing Figures

PHOTOGRAPHIC FILM UNIT WITH TAPS ON BINDING ELEMENT

BACKGROUND OF THE INVENTION

This invention relates to photographic film units of the self-developing type in which liquid processing composition is spread in a thin layer between dimensionally stable sheet elements of the film unit to process an exposed area of photosensitive material to form an image, and particularly to film units of this type in which the dimensionally stable layers are retained in superposition prior to, during and subsequent to exposure and processing by a sheet-like external binding means secured around and to at least three edges of the dimensionally stable elements.

While this structure has proved essentially satisfactory for controlling the extent and thickness of the layer of processing composition spread for permeation into the photosensitive material, in many structures of the type under consideration herein where gap, that is the distance between rollers, is extremely critical and very small, at the point where the rollers impress upon the trap area it is possible that excess processing composition which has already arrived at the trap area can be "blown back" into the viewing area of the photographic film unit by the pressure applied by the rollers. This "blow back" of excess processing composition can form a thin area of discoloration near the trap end of the film unit, e.g., a bluish hue. The present invention essentially eliminates processing composition "blow back" and, accordingly, eliminates the line of discoloration which is sometimes found at the trap end of integral instant photographic film units by increasing the gap between the pressure-applying members after the exposed area has passed therebetween and before the trap reaches the pressure-applying members. This is accomplished by employing integral portions of the binding element. For a different approach to providing an increase in gap as the trailing end of a film unit passes through pressure-applying members, see U.S. Pat. No. 3,607,285.

SUMMARY OF THE INVENTION

It has been found that by providing, immediately inboard from the film unit trap, that is, immediately adjacent the film unit trap leading edge, a slight increase in thickness of the binding material, processing composition "blow back" is substantially eliminated. This slight increase in thickness is provided by cutting the binder sheet with a slight tab on either side of the area adjacent the trap so that when the binder sheet is folded over, the tab material may be folded to provide an additional thickness of binder sheet just inboard of the trap area. Then as the rollers proceed to spread processing composition between the sheets comprising the film unit, just before it reaches the trap area, the gap between the pressure-applying members will be slightly widened, and then will be widened again as they pass over the trap. Any "blown back" processing composition will be contained in this slightly widened area inboard of the trap rather than migrating into the image viewing area of the film unit.

It is, accordingly, an object of the present invention to provide, in photographic film units of the type described, novel and improved means for controlling the gap between the pressure-applying members at a point just inboard of the trap area of the film unit.

It is a further object of the present invention to provide binding means for an integral photographic film unit which comprises tabs foldably disposed adjacent trap element, and slightly inboard therefrom to provide an area of greater gap than the average thickness of the bound lateral edges of the film unit.

Other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention, reference should be had to the following detailed description taken in connection with the accompanying drawings.

Description of the Prior Art

Numerous forms of photographic, self-developing assemblages have been proposed in the prior art as well as being sold commercially including both roll film and individual film units. The type of film assemblage or unit with which the present invention is concerned generally comprises a pair of sheets, one of which serves as a support for a photosensitive image-recording medium and a rupturable container of a viscous liquid processing agent adapted to be distributed in a thin layer in contact with an exposed area of the photosensitive medium by superposing the sheets and advancing them between a pair of pressure-applying members to distribute the processing liquid between the sheets for permeation into the recording medium. The photosensitive sheet (carrying the photosensitive medium) and an image-receiving sheet are retained in superposed relation prior to, during, and subsequent to exposure and processing. Film units of this type are disclosed, for example, in U.S. Pat. Nos. 3,415,644, 3,473,925, 3,550,515, 3,578,540, 3,589,904, 3,607,285, 3,615,421, 3,615,436, 3,615,539, 3,615,540, 3,619,192, 3,619,193, 3,621,768, 3,652,281, and 3,652,282.

It is important in film units of the type described in the aforementioned U.S. patents to spread the processing liquid in a layer of uniformly predetermined thickness throughout the area exposed and processed preferably to produce an image visible through one of the sheets. One approach to liquid spreading and spread thickness control is to employ juxtaposed pressure-applying members, particularly rollers, resiliently biased toward one another and move the film unit therebetween to first eject the liquid from a rupturable container attached to the sheets near the leading end of the area to be processed and then progressively spread the mass of ejected liquid toward the trailing end of this area and the sheets. Liquid spread thickness control is achieved by providing sheet-like spacing elements at least at the lateral margins of the sheets for separating the medial portions of the pressure-applying members and sheets in the area to be processed in order to provide space between the sheets in which the liquid is spread. Heretofore, such spacing means have taken the form of uniformly thick or tapered layers or sheets formed of such materials as paper, organic plastics, and metallic foil, or combinations thereof, in the form of sheets or layers having openings defining the image or strips and/or combinations of strips and sheets adapted to define the area to be processed.

In the film unit structure described in the aforementioned patents, these spacing means are designed to perform a number of functions in addition to spread thickness control including masking of non-image areas e.g. forming a border, and securing the two sheets to one another at at least their lateral and trailing end margins. For this purpose, the spacing means take the form of a generally rectangular sheet formed with a rectangular exposure and/or /viewing opening surrounded on at least three sides by lateral and trailing end marginal portions secured to one of the photosensitive and image receiving sheets, folded around the lateral and trailing end edges of the sheets and secured to the other of the photosensitive and second sheets.

DESCRIPTION OF THE INVENTION

Figure 1:
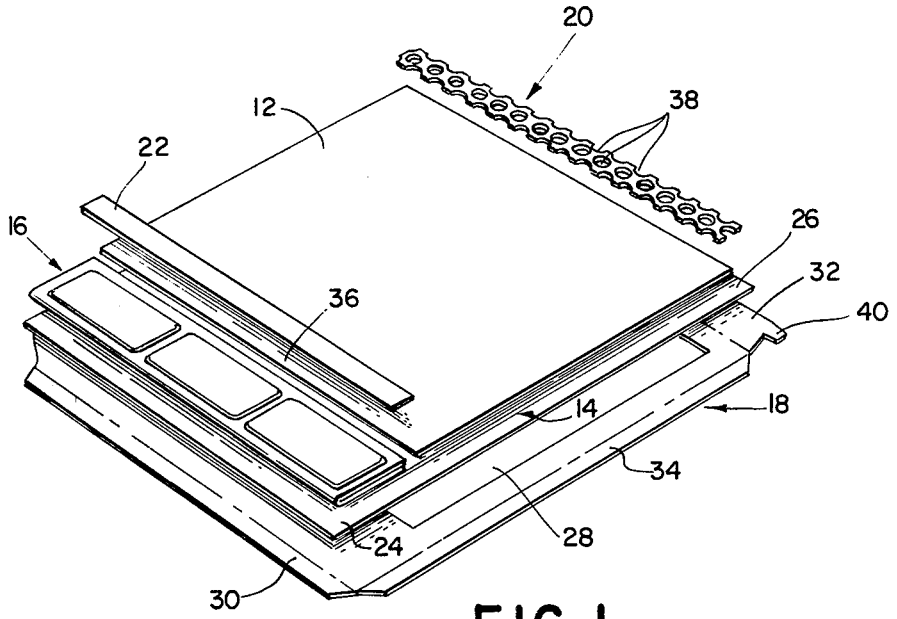
FIG. 1 is an exploded perspective view of the film unit of the present invention illustrating the details of the structure thereof.

Reference is now made to FIG. 1 of the drawings where there is illustrated in exploded perspective view a typical film unit of the type embodying the invention as described hereinabove. The film unit generally includes a photosensitive or image-recording sheet 12 and a second sheet 14 capable of recording a transfer image in a rupturable container 16 holding a quantity of processing composition. The two sheets and processing composition preferably include all of the materials and reagents required to produce a full color photographic print by the well-known diffusion transfer process as exemplified, for instance, in the aforementioned patents and particularly in U.S. Pat. No. 3,415,644. These patents describe film units adapted to produce full color images by diffusion of an image-forming material to an image-receptive layer through a layer associated with a photosensitive silver halide material. These references describe in detail the composition and arrangement of the various layers which comprise the two sheet-like elements of the film unit and the composition of the processing material employed to initiate visible image formation and provide transfer functionality.

As disclosed in U.S. Pat. No. 3,415,644, a preferred full-color image forming process involves the use of a photosensitive element containing a silver halide emulsion and a dye developer, that is, a dye which is a silver halide development agent. The photosensitive element is adapted, following exposure, to be wetted by a liquid processing composition in the absence of light and then superposed with a sheet-like support element which may be utilized as an image-receiving element in a preferred embodiment. The liquid processing composition is applied to the photosensitive element as a substantially uniform layer as the photosensitive element is brought into superposed relation with the image-receiving element by moving the two elements between a pair of juxtaposed members. The liquid processing composition is introduced and spread between the two elements for permeation into the photosensitive layer to initiate development of the latent image formed therein. The dye developer is immobilized or precipitated as a consequence of the development of the latent image while in unexposed and partially exposed areas of the emulsion, the dye developer is unreacted and diffusible and thus provides an imagewise distribution of unoxidized dye developer dissolved in the liquid processing composition as a function of the point-to-point degree of exposure of the silver halide emulsion. At least part of this imagewise distribution of unoxidized dye developer is transferred by diffusion to a superposed image-receiving layer to form reversed or positive color image of the developed image.

In addition to photosensitive sheet 12, image-receiving sheet 14 and container 16, the film unit includes a mask-binding sheet 18, a trap 20 and a sealing strip 22. Sheets 12 and 14 are preferably rectangular and substantially equal in width. They are arranged in superposed face-to-face contact with one another and their lateral edges in substantial alignment. Sheet 14 is substantially longer than sheet 12 and includes a leading end section 24 extending beyond the leading edge of sheet 12 generally by an amount slightly longer than the shorter dimension of container 16 and a trailing end section 26 which extends a short distance beyond the edge of sheet 12 in a preferred embodiment of the film unit. Although sheets 12 and 14 are separate and distinct, they are preferably laminated to one another throughout substantially the entire area of their facing surfaces except for a narrow region adjacent the leading edge of sheet 12. This provides for a more stable and easier to handle structure while eliminating the problem of air entrapment between the sheets. In the preferred embodiment photosensitive element 12 will be exposed through image-receiving element 14.

Elements 12 and 14 are secured in face-to-face relation at their lateral and trailing end margins by binding sheet 18, which is formed with a generally rectangular exposure opening 28 slightly smaller than sheet 12 and defining the area of the photosensitive sheet adapted to be exposed. Binding sheet 18 is preferably formed of an opaque white material such as, for example, a laminate including a layer of paper, a polymeric material and an opaque layer such as a metallic coating and/or pigment carried on or within a layer of sheet 18. The binding sheet 18 is larger than image-receiving element 14 and includes a leading end section 30, a trailing end section 32 and lateral marginal sections 34 adapted to be folded along the broken lines shown in this figure. Binder 18 is adhered to the outer surface of sheet 14 substantially over the entire area of the surface of the image-receiving sheet surrounding the exposure opening 28. Lateral marginal sections 34 of sheet 18 are folded around lateral edges of sheets 12 and 14 and secured to the margins of sheet 12. On trailing end section 32 of sheet 18 toward the outermost area, tabs 40 are provided. As the trailing end section 32 of sheet 18 is folded around the trailing edge of sheet 14 and secured to the outer surface of photosensitive sheet 12 near the trailing end thereof, over and surrounding trap 20, tabs 40 are folded inward of the lateral edges and are positioned, as the trailing end 32 is secured in place, just inboard of trap 20 to thereby provide an additional thickness to the film unit just inboard of the trap, that is on the leading edge side of the trap. The folded tab will not generally extend beyond the edge of flap 34. While tabs 40 have been described integral with end 32, it will be appreciated that they may be integral with each flap 34, respectively.

Container 16 is a conventional diffusion transfer processing composition retaining pod described in numerous of the patents recited hereinabove and comprises a blank of fluid impervious sheet material sealed to form a cavity for containing processing liquid. The container is divided into three sections to thereby obtain improved distribution of processing composition upon discharge therefrom. The seal next adjacent the photosensitive element is weaker than the seals at the ends and rear of the container so that upon application of a predetermined compressive force to the walls of the container, there will be generated within the liquid hydraulic pressure sufficient to separate the marginal section adjacent the photosensitive element to thereby form three discharge passages extending throughout the width of the exposure area.

Container 16 is mounted on the leading edge section 24 of sheet 14 adjacent the leading edge of sheet 12 in position to discharge its liquid contents between the photosensitive and image-receiving sheets. Container 16 is secured in place by portions of lateral edge sections 34 of binding sheet 18 and leading end section 30 of binding sheet 18 which are folded around the edges of sheet 14 and secured to three of the edges of the container. Sealing strip 22 is secured to the rupturable marginal section of the container and the leading end margin of photosensitive sheet 12 and cooperates with the container and sheets to bridge the gap between the container and the photosensitive sheet to form a conduit for conducting the liquid from the container between the photosensitive and image-receiving sheets.

In the processing of the film unit of the present invention, it is advanced, container first, between a pair of pressure-applying members, preferably rollers, which initially apply compressive pressure to the container to eject its contents as a mass between the photosensitive and image-receiving sheets and then distribute the mass of processing composition between the sheets toward the trap end of the film unit and form a layer of substantially uniform predetermined thickness which is continuous and at least coextensive with the area defined by exposure opening 28. While it is desirable to provide a minimum of processing composition within the container, in order to insure that sufficient processing composition is present to form a layer of the requisite area and thickness between the sheets, it is necessary to provide excess processing composition in container 16.

The film unit must, accordingly, include trapping means 20 for collecting and retaining this excess processing composition so that it does not escape from the film unit. This trapping element 20 is generally a narrow strip of relatively thick sheet material formed with perforations and indentations 38 which occupy up to about 55% of the element. It is secured between the trailing end section 32 of the image-receiving element and binding sheet 18 to provide spaces for collecting and retaining excess processing liquid overrun. The trapping element also functions as a spacer as the trailing end portion of the film unit passes between the pressure-applying members preventing the processing liquid from being further advanced in the direction of spreading. In the embodiment shown, as the film unit advances between the pressure-applying members toward the trap end, folded tabs 40 increase the gap between the rollers just prior to the trap element thereby eliminating, or at least minimizing the possibility of "blow back" of processing composition which has already reached the trap area, into the viewing portion of the ultimate image, that is, the area surrounded by exposure aperture 28.

Film units of the type embodying the present invention are designed to remain intact following distribution of the processing liquid between sheets 12 and 14, i.e., the sheets are retained in superposed relation and so that the transfer image is viewed through the imagereceiving layer. In the film unit of FIG. 1, the dye transfer image is formed in a layer carried by sheet 14 which is necessarily transparent, and the processing liquid includes a light-reflecting agent for masking the image formed in the photosensitive layer and providing a suitable background for viewing the positive image. A suitable light-reflecting agent for this purpose is titanium dioxide. The light reflecting agent performs an additional function and that is cooperating to prevent exposure of the photosensitive layer during image formation in the presence of ambient light, thus permitting the film unit to be advanced between the pressure-applying members directly into the light thus making it unnecessary to provide a processing chamber within the camera in which the film unit is exposed. Additional opacity may be obtained by providing a light-absorbing agent such as carbon black in very small concentration, and more preferably a pH-sensitive optical filter agent as described in U.S. Pat. No. 3,647,437.

Numberous trapping materials which may be used in the present invention are disclosed in the patent literature. For example, a typical trap material is disclosed in U.S. Pat. No. 3,761,269.

Figure 2:
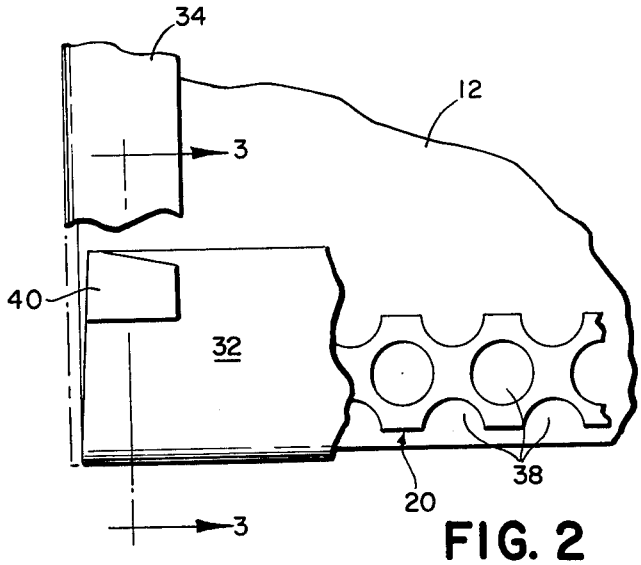
FIG. 2 is a cut-away top view of the same corner of FIG. 1 showing the novel tabed binding element folded in place.
Figure 3:
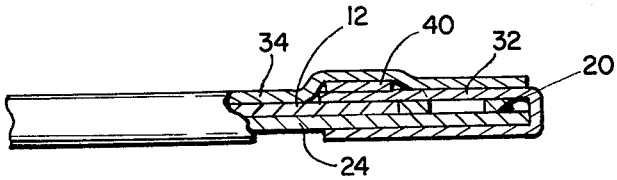
FIG. 3 is a side sectional view of the structure of FIG. 1 showing in detail the configuration of one corner of the film unit comprising the trap area with the novel tabed binding sheet of the present invention folded in place.

Referring now to FIG. 2 of the present invention, a partial cut-away corner view of the film element of FIG. 1 is shown. Image-receiving element 14 is shown in superposed position with photosensitive element 12 which extends nearly to the edge of element 14. Holding elements 12 and 14 in place is binder 18 which is shown in engaging relationship with trap 20. Just inboard of trap 20 is tab 40 which is shown providing a slightly greater thickness to the image-receiving element just inboard of the tab than the thickness along the longitudinal edges of the film unit. The same phenomenon can be visualized with respect to FIG. 3 where tab 40 is shown just inboard of trap 20 in a cut-away top view. Binding element 18 is shown broken away so that tab 40 and trap 20 can be visualized in relation to one another.

It will be seen from the foregoing that the present invention achieves its basic objective of providing a film structure assuring a uniform processing liquid layer spread thickness and substantially reducing, if not eliminating, excess processing composition "blow back" from the trap by employing the simple, inexpensive and easily fabricated expedient of a tab on the binding element positioned so that it provides a slight increase in thickness, or increase in gap, at a point just inboard of the processing composition trap.

Since certain changes may be made in the above product without departing from the scope of the invention herein involved, it is intended that all matter contained in the above description or shown in the accompanying drawings shall be interpreted as illustrative and not in a limiting sense.

What is claimed is:

1. In a diffusion transfer photographic film unit adapted to be processed to form a visible image by moving the film unit between pressure applying members to distribute a processing composition from the leading end to the trailing end thereof, said film unit comprising:

a photosensitive element;

an image receiving element in face to face relationship with said photosensitive element thereby forming an assembly having a leading and trailing end joined by lateral edges;

a quantity of processing composition releasably contained along the leading end of said assembly for distribution between said photosensitive and said image receiving elements in response to movement of said elements between a pair of pressure-applying members;

a trap having a leading and trailing edge affixed along the trailing end of said assembly for retaining excess processing composition; and a binding element extending around at least the trailing end and lateral edges of the assembly and securing the photosensitive and image-receiving elements to one another in order to retain said sheets in superposition and prevent escape of processing composition from between the sheets wherein said binding element comprises an exposure aperture for exposing said photosensitive sheet therethrough, said exposure aperture comprising a leading and trailing edge;

the improvement which comprises two tabs integral with said binding element, each of which is folded immediately adjacent a lateral edge of said film at a point adjacent and inboard the leading edge of the trap; and whereby an increase in thickness of the binder element of the film unit is achieved adjacent the leading edge of the trap.

2. The film unit of claim 1 wherein said tabs are folded between the leading edge of the trap and the trailing edge of said exposure aperture.

* * * * *